US005488994A

United States Patent [19]

Laurel et al.

[11] Patent Number: 5,488,994

[45] Date of Patent: Feb. 6, 1996

[54] INFLATION PACKER METHOD AND APPARATUS

[75] Inventors: David F. Laurel; James F. Heathman, both of Duncan, Okla.; Kenneth P. Marcel, Lafayette, La.

[73] Assignee: Halliburton Company, Duncan, Okla.

[21] Appl. No.: 296,063

[22] Filed: Aug. 24, 1994

[51] Int. Cl.[6] ..... E21B 33/129

[52] U.S. Cl. ..... 166/387; 166/187

[58] Field of Search ..... 166/387, 187, 166/285

[56] References Cited

U.S. PATENT DOCUMENTS

| | | | |
|---|---|---|---|
| 2,945,541 | 7/1960 | Maly et al. | 166/187 X |
| 3,918,522 | 11/1975 | Suman, Jr. | 166/187 X |
| 4,155,404 | 5/1979 | Hollingsworth | 166/187 X |
| 4,378,843 | 4/1983 | Suman, Jr. | 166/387 X |
| 4,714,117 | 12/1987 | Dech | 166/187 X |
| 5,314,015 | 5/1994 | Streich et al. | 166/184 |

*Primary Examiner*—Hoang C. Dang
*Attorney, Agent, or Firm*—Stephen R. Christian

[57] ABSTRACT

An inflation packer apparatus includes an inflatable packer bladder and uses cementitious fluid as an inflation fluid. The packer apparatus includes a packer mandrel having a central flow passage therethrough and an outer packer body which includes the inflatable packer bladder. A chemical accelerating agent is employed to accelerate the hardening time of the cementitious fluid used to inflate the packer bladder. An annular inflation fluid passageway is defined between the mandrel and the body. Inflation fluid passes from the central flow passage into the annular inflation fluid passageway to inflate the inflatable packer bladder. The mandrel has grooves defined on an outer surface thereof. The chemical accelerating agent is placed in grooves defined on the outer surface of the mandrel so that the accelerating agent is dispersed into the fluid passing into the annular passageway.

29 Claims, 3 Drawing Sheets

INFLATION PACKER METHOD AND APPARATUS

BACKGROUND OF THE INVENTION

Field of the Invention

The present invention generally relates to an inflation packer method and apparatus. More specifically, but not by way of limitation, this invention relates to an improved inflation packer which uses cementitious fluid as an inflation fluid and which utilizes an accelerating agent to accelerate the hardening time of the fluid.

Typically, inflation packer assemblies utilize either mud or cement to inflate a packer bladder so that the bladder seals against a well bore. Mud inflation systems typically utilize a valve system to maintain pressure in the bladder, while cement systems generally rely on the compressive strength of the gelled or hardened cement. Both systems have inherent problems.

Because a packer inflated with mud is dependent solely on the valve system, the packer is susceptible to leakage which will cause the bladder to deflate. Cement used to inflate the bladder takes several hours to develop sufficient compressive strength to support a weight above it. Because of such inherent problems, packers using either cement or mud are susceptible to hydrostatic differential pressure in the well bore which can cause the packer bladder to move, thereby breaking the seal between the packer and the well bore.

SUMMARY OF THE INVENTION

The present invention provides an improved inflation packer method and apparatus which eliminates the problems experienced when utilizing prior art inflation systems. The invention comprises an inflation packer assembly which uses a multi-purpose cementitious fluid as the inflation fluid to inflate the bladder, an accelerator to accelerate the gelling or hardening of the cementitious fluid, and includes a valve system to inflate the bladder and to displace the fluid.

The inflation packer apparatus of the present invention has a packer body which includes a packer element. The packer element includes an inflatable packer bladder. A packer mandrel with a central flow passage defined therethrough is disposed in the packer body. The packer mandrel generally may be comprised of an upper packer mandrel with a central bore and a lower packer mandrel which also has a central bore. The central bores of the upper and lower mandrels generally makeup the central flow passage. The packer apparatus also includes an inflation passage means for communicating inflation fluid from the central flow passage in said packer mandrel to the inflatable packer bladder.

The inflation passage means generally includes a longitudinally extending annular inflation fluid passageway defined between the packer mandrel and the packer body, and an inflation port defined in the packer mandrel which communicates the central flow passage with the annular inflation fluid passageway.

The apparatus also includes a communication or circulation means for communicating the central flow passage with a well bore. The circulation means is operably associated with the packer bladder, so that the circulation means will not communicate the central flow passage with the well bore until the packer bladder reaches a desired inflation pressure. The circulation means generally includes the inflation port and a circulation port defined through the packer body. The circulation port will initially be closed with a rupture disk or other closure means installed therein, so that fluid passing through the inflation port passes into the annular passageway and into the inflatable packer bladder. The circulation port will open after the packer bladder reaches its maximum or desired inflation pressure thereby communicating the central flow passage with the well bore.

The invention includes a chemical accelerating compound which is operably associated with the inflation passage means, so that the accelerating compound reacts with the inflation fluid to accelerate the hardening time of the inflation fluid. Typically, the chemical accelerating compound will be placed in the annular inflation fluid passageway prior to the time the packer apparatus is lowered into the well bore, so that as the cementitious fluid used to inflate the packer bladder passes through the annular inflation fluid passageway, the chemical accelerating agent is dispersed throughout the fluid.

The annular inflation fluid passageway may have a check valve disposed therein which divides the passageway into an upper portion and a lower portion. The inflation port communicates the central flow passage with the upper portion of the annular inflation fluid passageway. The check valve allows inflation fluid to pass from the upper portion of the passageway to the lower portion of the passageway, but prevents fluid from flowing in the opposite direction. The inflatable packer bladder is disposed about the lower packer mandrel adjacent the lower portion of the annular inflation fluid passageway. Thus, the check valve provides a means for inflating the inflatable packer bladder and for holding fluid pressure in the lower portion of the annular inflation fluid passageway thereby maintaining pressure in the packer bladder.

The chemical accelerating compound is placed in the lower portion of the annular inflation fluid passageway. The portion of the packer mandrel adjacent to the lower inflation fluid passageway, which ordinarily comprises the lower packer mandrel, has spiral grooves defined on an outer surface thereof. The accelerating agent is placed in the spiral grooves defined on the outer surface of the packer mandrel, so that the accelerating agent will be evenly dispersed in the inflation fluid.

The method of the present invention generally comprises attaching to a tubing string an inflation packer assembly comprising an inflatable packer bladder and lowering the packer assembly into a well bore. The method further comprises circulating a fluid through the packer assembly as it is lowered into the well, pumping a cementitious fluid into the packer assembly after the packer apparatus reaches a desired depth, inflating the inflatable packer bladder with the cementitious fluid and accelerating the hardening time of the fluid.

The accelerating step generally includes placing a chemical accelerating agent in the packer apparatus prior to lowering the assembly into the well bore, and dispersing the agent into the fluid used to inflate the bladder. The agent is generally placed in an inflation fluid passageway between a packer mandrel and a packer body. The method may then be carried out by blocking or obstructing flow in the central flow passage, directing flow into the annular passageway, and dispersing the agent into the cementitious fluid directed into the passageway. The method may further comprise communicating the well bore with the central flow passage above the packer bladder after the bladder is inflated, so that the cementitious fluid, or other fluid passing through the central flow passage call be communicated into the well bore. Thus, an object of the present invention is to provide an improved inflation packer for use in a well bore when cementation is to take place off the bottom of the well bore, such as, but not by way of limitation, setting sidetrack plugs, or setting a plug in a well that is to be abandoned. Another object is to provide a method for accelerating the gelling or hardening time of fluid used to inflate a packer bladder.

DETAILED DESCRIPTION OF THE PREFERRED EMBODIMENTS

Figure 1A:
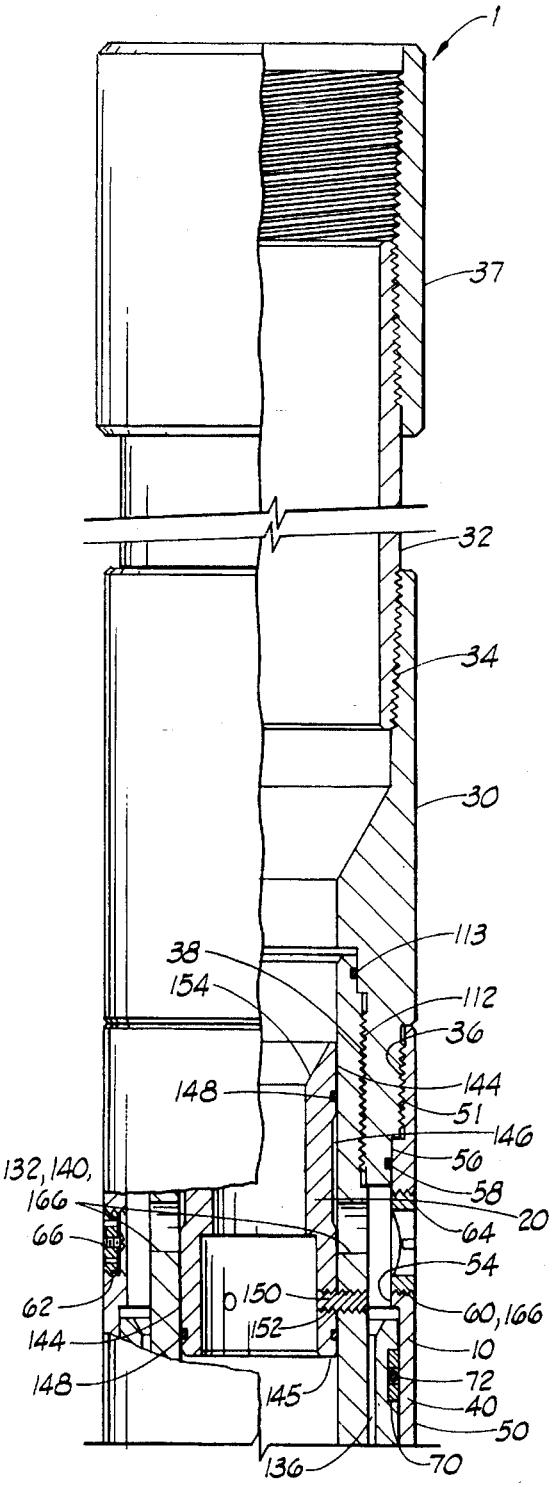
FIGS. 1A–1D shows an elevation partial section view of the packer apparatus of the present invention.
Figure 1B:
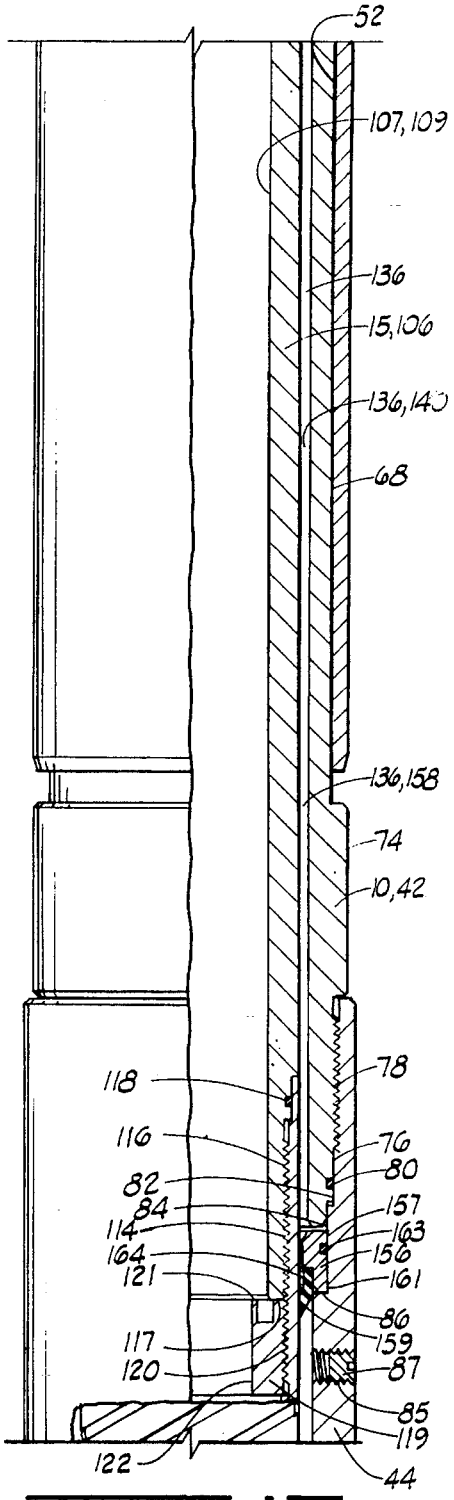
Figure 1C:
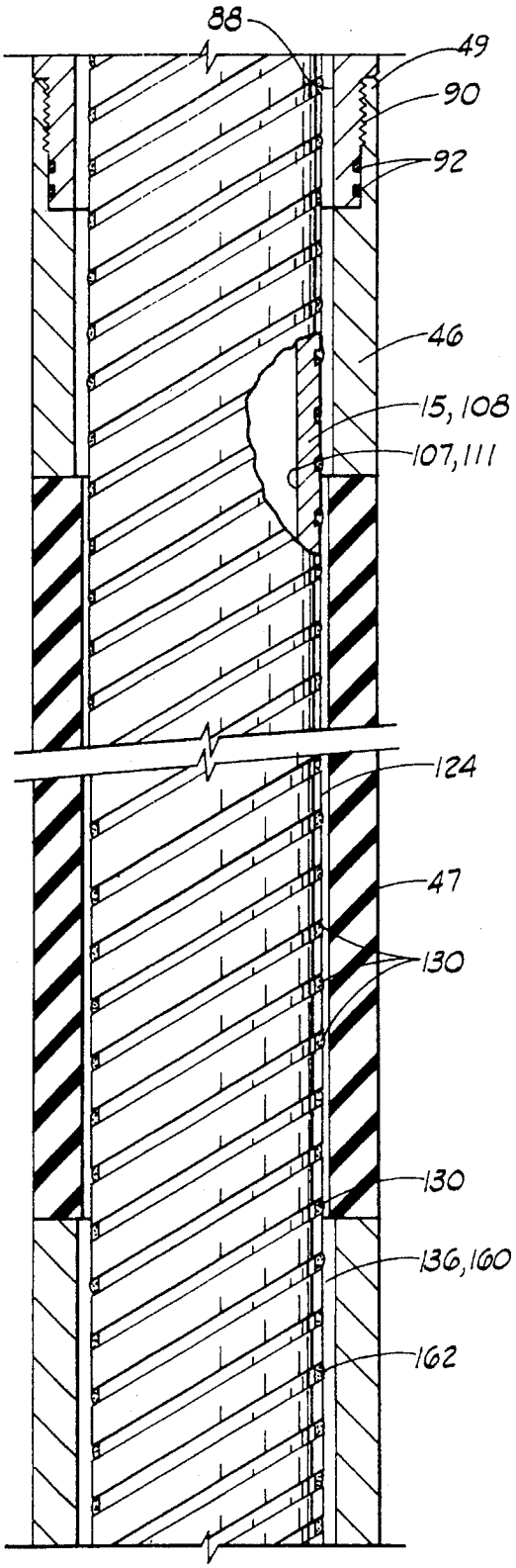
Figure 1D:
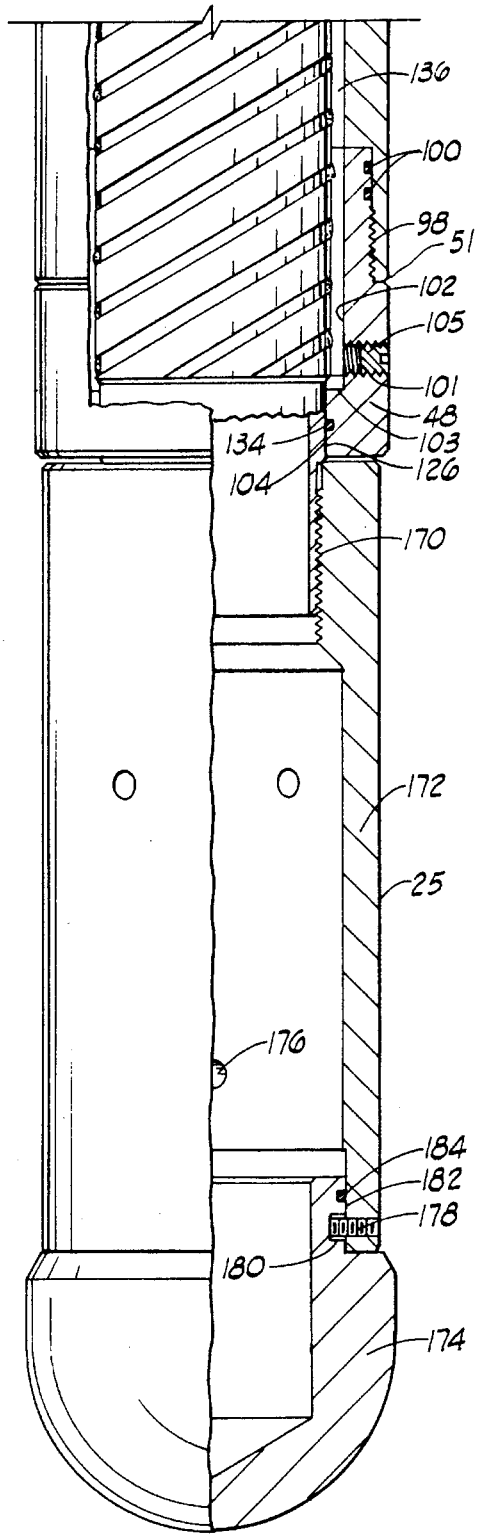
Figure 2:
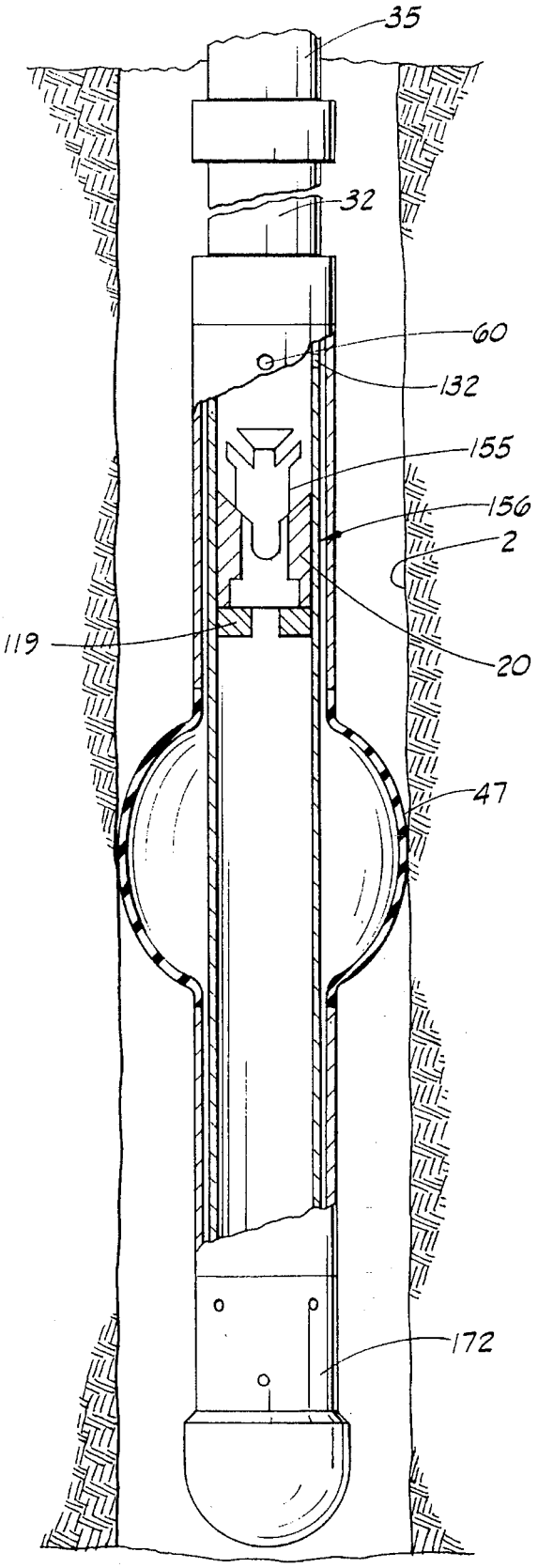
FIG. 2 shows a schematic of the present invention in a well bore with the packer inflated.

Referring now to the drawings, FIGS. 1A–1D illustrate the inflatable packer apparatus of the present invention, which is generally designated by the numeral 1. The inflatable packer apparatus generally includes a substantially cylindrical packer body 10, a substantially cylindrical packer mandrel 15, an inflation port opening sleeve 20, a fluid diverter assembly 25 and a lift sub or upper adapter 30. Lift sub 30 may be connected at its upper end to a tail pipe 32 at threaded connection 34. Tail pipe 32 is adapted to be connected to a tubing string 35 thereabove with a threaded coupling 37. Alternatively, lift sub 30 may be connected directly to tubing string 35. The apparatus 1 is shown in FIG. 2 attached to tubing string 35 extending into a well bore 2.

Lift sub 30 has an outer thread 36 and an inner thread 38 defined at its lower end. Packer body 10 includes an upper body extender 40, a lower packer body extender 42, an upper end ring 44, a packer element 46 which includes an inflatable packer bladder 47, and a lower end ring 48. FIG. 2 show a schematic of the apparatus with the packer bladder 47 inflated to seal against the side of well bore 2. Upper packer body extender 40 is connected at threaded connection 51 to lift sub 30 at threads 36. Upper body extender 40 includes an outer surface 50 and an inner surface 52, which includes an inwardly extending lug 54. Inwardly extending lug 54 engages an outer surface 56 of lift sub 30 with a seal provided therebetween by O ring seal 58. Inwardly extending lug 54 has a circulation port 60 and a valve port 62 defined therethrough. The upper body extender may include a plurality of circulation ports 60. A rupture disc 64 is threadedly received in circulation port 60 and a pressure regulating valve 66 is threadedly received in valve port 62.

Lower body extender 42 includes a first outer surface 68 which is closely received in upper body extender 40. A seal is provided between the upper and lower body extenders with an O ring seal 72. The seal is disposed in a groove 70 defined on the outer surface 68 of lower body extender 42. Lower body extender 42 further includes a second outer surface 74 and a third outer surface 76. Lower body extender 42 is connected to upper end ring 44 at threaded connection 78 with a seal provided therebetween by O ring seal 80. O ring seal 80 provides a seal between third outer surface 76 of the lower body extender and a first inner surface 82 of upper end ring 44. Upper end ring 44 further includes a second inner surface 84, an upwardly facing shoulder 86 and third inner surface 88. An upper accelerator fill port 85 is defined radially through end ring 44, and has a threaded plug 87 received therein.

Packer element 46 has an upper end 49 and a lower end 51. Packer element 46 is connected at its upper end 49 to upper end ring 44 at threaded connection 90 with a seal provided therebetween by O ring seals 92. Packer element 46 is connected at its lower end 51 to lower end ring 48 at threaded connection 98 with a seal provided therebetween by O ring seals 100. Lower end ring 48 includes a first inner surface 102, upward facing shoulder 103 and a second inner surface 104. A lower accelerator fill port 101 is defined through lower end ring 48, and has a threaded plug 105 received therein.

Packer mandrel assembly 15 includes an upper mandrel 106 and a lower mandrel 108. Upper mandrel 106 and lower mandrel 108 include central bores 109 and 111 respectively. Central bores 109 and 11 may be referred to collectively as a central flow passage 107. Upper mandrel 106 is connected to inner threads 38 of lift sub 30 at threaded connection 112, with a seal provided therebetween by O ring seal 113. Upper mandrel 106 is connected to an upper inner thread 114 of lower mandrel 108 at threaded connection 116. A seal is provided between upper mandrel 106 and lower mandrel 108 by O ring seal 118. A stop collar 119 is connected to threads 114 below a lower end 117 of upper packer mandrel 106 at threaded connection 120. Stop collar 119 includes an upper surface 121 and a central bore 122. Central bore 122 of stop collar 119 has a diameter smaller than central bore 109 of upper mandrel 106. Upper surface 121 therefore extends radially inwardly into central flow passage 107.

Lower mandrel 108 includes a first outer surface 124 and a second outer surface 126. First outer surface 124 of lower mandrel 108 has a plurality of spiral grooves 130 defined thereon. The mandrel preferably includes from 3 to 9 grooves, and more preferably includes 6 grooves. Second outer surface 126 of the lower mandrel is closely received in second inner surface 104 of lower end ring 48. A seal is provided between lower mandrel 106 and end ring 48 by a resilient O ring seal 134.

A longitudinally extending annular inflation fluid passageway 136 is defined between packer mandrel 15 and the packer body 10. Passageway 136 terminates at upward facing shoulder 103 of lower end ring 48. Upper mandrel 106 has an inflation port, and may include a plurality of inflation ports, 132 radially defined therethrough which communicates central flow passage 107 with annular inflation fluid passageway 136. Pressure regulating valve 66 allows fluid to flow only in a direction into annular inflation passageway 136 from the well bore 2, thus equalizing the pressure in the well bore and the passageway and preventing inflatable packer bladder 47 from collapsing as the apparatus is lowered into the well bore. Inflation port 132 and annular inflation fluid passageway 136 may be referred to as an inflation passage means 140 for communicating inflation fluid to packer bladder 47.

Flow through inflation port 132 is initially blocked by inflation port opening sleeve 20, which is closely received in central bore 109 of upper mandrel 106. Inflation port opening sleeve 20 includes an outer surface 144, a recessed surface 146 and a lower end 145. A seal is provided between bore 109 and surface 144 by a plurality of O rings 148. Opening sleeve 20 is releaseably attached in bore 109 with shear pins 150 which extend radially into upper mandrel 106 and into a plurality of apertures 152 defined in opening sleeve 20. Opening sleeve 20 further includes a plug or ball seat 154 defined on its upper surface for receiving an opening dart or opening ball 155. The opening dart 155 will be dropped through the tubing string into central flow passage 107 until it is received in seat 154, blocking flow through the central passage 107. The opening dart is shown schematically in FIG. 2, and may be of any type known in the art. Pressure is increased in the tubing string causing shear pins 150 to break off, releasing opening sleeve 20 from upper mandrel 106. Opening sleeve 20 falls through central flow passage 107 until the lower end 145 thereof engages upper surface 121 of stop collar 119, thereby blocking flow through central flow passage 107 and directing flow through inflation port 132 into annular inflation fluid passageway 136.

A check valve assembly 156 is disposed in annular inflation fluid passageway 136 dividing the passageway into an upper portion 158 and a lower portion 160. Check valve 156 includes a backup ring 157 with a seal 159 attached thereto. Backup ring 157 has an outer surface 161 which is closely received in second inner surface 84 of upper end ring 44, with a seal provided therebetween by O ring seal 163. Backup ring 157 further includes a lower surface 164 which abuts upward facing shoulder 86 of end ring 44. Check valve 156 allows fluid to flow only in a direction from upper portion 158 to lower portion 160 of annular inflation fluid passageway 136o Packer bladder 47 is adjacent to lower portion 160 of the annular passageway. Inflation fluid therefore passes from central flow passage 107 through inflation port 132 and into the upper portion 158 of the annular inflation fluid passageway. Inflation fluid then passes into lower portion 160 of the passageway, thereby inflating packer bladder 47, as shown in FIG. 2, so that the bladder 47 seals against well bore 2.

A chemical accelerating agent 162 is operably associated with inflation passage means 136 so that the accelerating agent disperses into the inflation fluid used to inflate packer bladder 47. Accelerating agent 162 accelerates the gelling or hardening time of the inflation fluid. The chemical accelerating agent is placed in annular inflation fluid passageway 136 so that it is dispersed into the inflation fluid as it passes into the passageway 136. In the preferred embodiment, the inflation fluid constitutes a cementitious fluid. The accelerating agent may include, but is not limited to, Calcium Chloride ($Ca\ Cl_2$), Triethylamine (TEA), Diethylamine (DEA), Sodium Aluminate ($A1\ Na\ O_2$) and Sodium Silicate. Generally the accelerating agent is placed in lower portion 160 of the annular passageway 136 and more specifically in grooves 130, which are defined on lower mandrel 108 adjacent the lower portion 160 of passageway 136. The grooves provide a means for evenly dispersing the agent into the inflation fluid as it passes into lower portion 160 of the annular passageway. The accelerating agent may be placed in the passageway through upper and lower accelerator fill ports 85 and 101 respectively.

Thus, once the inflation port opening sleeve is released, inflation fluid flows through inflation port 132 into upper portion 158 of the annular inflation fluid passageway and into lower portion 160, where chemical accelerating agent 162 is dispersed into the inflation fluid. Inflation fluid is pumped into central flow passage 107 and directed into the annular inflation fluid passageway until packer bladder 47 reaches a maximum or desired inflation pressure.

Rupture disk 64 is operably associated with packer bladder 47, so that it ruptures when the bladder reaches its maximum inflation pressure, thereby communicating the well bore with the central flow passage 107 through inflation port 132 and circulation port 60. Inflation port 132 and circulation port 60 may thus be referred to as a communication or circulation means 166 for communicating fluid to the well bore from central flow passage 107. The circulation means 166 is operably associated with packer bladder so that, as described hereinabove, fluid is communicated to the well bore only after packer bladder 47 reaches its desired inflation pressure.

The lower mandrel 108 is connected to fluid diverter assembly 25 at threaded connection 170. Fluid diverter assembly 25 includes a fluid diverter sub 172 and a guide nose 174. Fluid diverter sub 172 has a plurality of jetting apertures 176 defined therethrough. The jetting apertures will jet fluid circulated through the apparatus upward and tangentially as the apparatus is lowered into a well bore. The jetting action will assist in and provides a means for breaking gelled mud and other debris from the well bore. Guide nose 174 is attached to fluid diverter sub 172 with a shear pin 178 which extends through fluid diverter sub 172 and into a groove 180 defined in a first outer surface 182 of guide nose 174. First outer surface 182 is closely received in fluid diverter sub 172. A seal is provided between fluid diverter sub 172 and guide nose 174 by an elastomeric O ring seal 184.

METHOD OF OPERATION

The method of the present invention generally includes providing a tubing string with the packer assembly of the present invention attached thereto and lowering the tubing string into a well bore. Fluid may be circulated through the tubing string and the packer assembly 1 as it is lowered into the well bore. The guide nose 174 will assist the apparatus as it is being lowered into the well bore. Jetting apertures 176 in fluid diverter sub 172 will jet fluid circulated through the apparatus upwardly and tangentially as the assembly is lowered into the well bore. The jetting action of the fluid will assist in breaking gelled mud and other debris from the side of the well bore as the tool is being lowered into the well bore.

Pressure regulating valve 66 equalizes the pressure in the annular inflation passageway 136 with the pressure in well bore 2 thereby preventing the inflatable packer bladder 47 from collapsing while the assembly is lowered into the well bore. Once the packer assembly reaches the desired depth, the method comprises pumping a cementitious fluid through the tubing string and into the packer assembly, inflating inflatable packer bladder 47 with the fluid, and accelerating the hardening time of the fluid. Chemical accelerating agent 162 is placed in the packer apparatus prior to lowering the apparatus in the well bore, so that it will be dispersed in the cementitious fluid used to inflate packer bladder 47. The cementitious fluid is communicated to the inflatable packer bladder by dropping ball plug 155 into the tubing string so that it engages with ball seat 154 of inflation port opening sleeve 20. Pressure is increased in the tubing string causing shear pins 150 to break thereby releasing opening sleeve 20. The lower end of opening sleeve 20 is retained in central flow passage 107 by an upper surface 121 of stop collar 119. Thus, flow through central flow passage 107 is blocked. Fluid pumped into central flow passage 107 is therefore directed through inflation port 132 and into longitudinally extending annular inflation passageway 136.

The cementitious inflation fluid passes from the upper portion 158 of annular inflation fluid passageway 136 to the lower portion 160 passageway. The portion of packer mandrel 15 adjacent the lower portion 160 of the passageway includes a plurality of grooves 130. Chemical accelerating agent 162 is placed in grooves 130 prior to lowering the apparatus into the well bore, and is dispersed into the cementitious fluid that passes into the lower portion 160 of the annular inflation fluid passageway 136. Inflation fluid is continually pumped to the central passageway 107 and into annular inflation fluid passageway 136 until inflatable packer bladder 47 reaches its desired or maximum inflation pressure thereby sealing against well bore 2. Fluid is prevented from flowing out of lower portion 160 of the passageway by check valve 156. The chemical accelerating agent dispersed in the inflation fluid accelerates the hardening or gelling time of the inflation fluid. The chemical accelerating agent is placed in the grooves through accelerator fill ports 85 and 105.

After the inflatable packer bladder reaches its maximum or desired inflation pressure, rupture disk 64 ruptures communicating central flow passageway 107 with the well bore through inflation port 132 and circulation port 60. Cementitious fluid can continually be displaced in the well bore for the purpose of, but not limited to, filling a well bore to abandon a hole, or for setting a sidetrack or kickoff plug.

Thus, it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A method of setting an inflation packer apparatus in a well bore comprising the steps of (1) providing a tubing string including said packer apparatus, said packer apparatus comprising an inflatable packer bladder;

(2) lowering said tubing string including said packer apparatus into said well bore;

(3) pumping a cementitious fluid into said tubing string and into a central flow passage defined in said packer apparatus;

(4) inflating said inflatable packer bladder with said cementitious fluid; and (5) accelerating the hardening time of said cementitious fluid after the fluid has been pumped into the central flow passage.

2. The method of claim 1 wherein said accelerating step comprises dispersing a chemical accelerating agent in said cementitious fluid prior to said inflating step.

3. The method of claim 1 wherein said packer apparatus comprises:

a substantially cylindrical packer body, said packer body including said inflatable packer bladder; and a substantially cylindrical packer mandrel, said central flow passage being defined therethrough, wherein said inflating step comprises;

directing said cementitious fluid from said central flow passage into an annular inflation fluid passageway defined between said packer body and said packer mandrel until said inflatable bladder reaches a desired inflation pressure; and holding said cementitious fluid under pressure in said inflation bladder.

4. The method of claim 3 further comprising:

communicating said central flow passage with said well bore after said inflatable bladder reaches said desired inflation pressure; and directing said cementitious fluid from said central flow passage into said well bore.

5. The method of claim 3 wherein said accelerating step comprises:

placing a chemical accelerating agent in said annular inflation fluid passageway prior to lowering said packer assembly into said well bore; and dispersing said chemical accelerating agent in said cementiticus fluid as said fluid is directed into said annular inflation fluid passageway.

6. The method of claim 5, wherein said placing step comprises:

filling a plurality of grooves defined on an outer surface of said mandrel with said chemical accelerating agent.

7. An inflation packer apparatus for sealing a well bore comprising;

a packer body comprising an inflatable packer bladder;

a packer mandrel having a central flow passage defined therethrough disposed in said packer body;

inflation passage means disposed in said inflation packer apparatus for communicating inflation fluid from said central flow passage to said inflatable packer bladder; and a chemical accelerating agent operably associated with said. inflation passage means, so that said accelerating agent is dispersed in said inflation fluid, thereby accelerating the hardening time of said inflation fluid.

8. The apparatus of claim 7 further comprising:

circulation means for communicating said central flow passage with said well bore, said circulation means being operably associated with said packer bladder so that said central flow passage is communicated with said well bore after said packer bladder is inflated to a maximum inflation pressure.

9. The apparatus of claim 8 wherein said circulation means comprises:

an inflation port defined in said packer mandrel communicated with said central flow passage; and a circulation port defined in said packer body communicated with said inflation port, said circulation port initially being closed, wherein said circulation port opens after said packer bladder reaches a maximum inflation pressure thereby communicating said central flow passage with said well bore.

10. The apparatus of claim 7 wherein said inflation passage means comprises;

an annular inflation fluid passageway defined between said packer mandrel and said packer body; and an inflation port defined in said packer mandrel, wherein said inflation port communicates said central flow passage with said annular inflation fluid passageway, so that said inflation fluid is communicated from said central flow passage to said annular inflation fluid passageway thereby inflating said inflatable packer bladder.

11. The apparatus of claim 10, wherein said accelerating agent is placed in said annular inflation fluid passageway, so that said accelerating agent is dispersed in said inflation fluid as it flows into said passageway.

12. The apparatus of claim 10, further comprising:

an inflation port opening sleeve disposed in said central flow passage, said inflation port opening sleeve being releasably retained in said packer mandrel and being initially located to obstruct flow through said inflation port; and a ball seat defined on said opening sleeve for receiving an inflation port opening ball dropped through said tubing string, so that after said ball is received in said ball seat said opening sleeve will be released thereby opening said inflation port.

13. The apparatus of claim 10 further comprising:

a check valve disposed in said inflation fluid passageway dividing said inflation fluid passageway into an upper portion and a lower portion, wherein said check valve allows fluid to flow from said upper portion to said lower portion but prevents flow in the opposite direction and wherein said accelerating compound is placed in said lower portion of said inflation fluid passageway.

14. The apparatus of claim 13, further comprising:

means for dispersing said accelerating agent evenly throughout said inflation fluid.

15. The apparatus of claim 14, wherein said means for dispersing said accelerating agent evenly comprises:

a plurality of spiral grooves defined on an outer surface of said packer mandrel adjacent said lower portion of said annular inflation fluid passageway, wherein said chemical accelerating compound is deposited in said spiral grooves.

16. The apparatus of claim 7 wherein said inflation fluid comprises a multi-purpose cementitious fluid.

17. The apparatus of claim 7, further comprising:

a fluid diverter sub attached to a lower end of said packer mandrel; and a guide nose, releaseably attached to said fluid diverter sub.

18. A method for sealing between a tubing string and a well bore comprising:

providing said tubing string, said tubing string including a packer assembly connected thereto, said packer assembly comprising;

a substantially cylindrical packer mandrel having a central flow passage therethrough;

a packer body disposed about said packer mandrel, said packer body comprising an inflatable packer bladder; and an annular inflation fluid passageway defined between said packer body and said packer mandrel; lowering said tubing string into said well bore; pumping a cementitious fluid into said central flow passage;

directing said cementitious fluid into said annular inflation passageway until said inflatable packer element reaches a desired inflation pressure; and accelerating the hardening time of said cementitious fluid after the fluid has been pumped into the central flow passage.

19. The method of claim 18 wherein said directing step comprises:

obstructing flow through said central flow passage; and communicating said central flow passage with said annular inflation fluid passageway.

20. The method of claim 18 wherein said accelerating step comprises:

placing a chemical accelerating agent in said annular inflation fluid passageway prior to lowering said tubing string into said well bore; and dispersing said accelerating agent into said cementitious fluid as said cementitious fluid is directed into said annular inflation fluid passageway.

21. The method of claim 18 wherein said packer mandrel comprises an upper mandrel and a lower mandrel, said lower mandrel having a plurality of spiral grooves defined on an outer surface thereof, wherein said accelerating step comprises:

placing an accelerating agent in said spiral grooves prior to lowering said tubing string into said well bore; and dispersing said accelerating agent into said cementitious fluid as said cementitious fluid is directed into said annular passageway.

22. The method of claim 18 further comprising, circulating a fluid through said tubing string and into said well bore during said lowering step.

23. An inflation packer apparatus comprising:

an upper adapter, for connecting said packer apparatus to a tubing string;

a substantially cylindrical outer packer body connected to said upper adapter, said outer packer body comprising an inflatable packer bladder;

a substantially cylindrical packer mandrel having a central flow passage defined therethrough disposed in said packer body, said packer mandrel having a plurality of spiral grooves defined on an outer surface thereof;

an annular inflation fluid passageway defined between said packer mandrel and said packer body;

an inflation port defined in said packer mandrel communicating said central flow passage with said annular inflation fluid passageway, so that an inflation fluid is communicated from said central flow passage into said annular passageway, thereby inflating said inflatable packer bladder; and a chemical accelerating agent placed in said spiral grooves, so that said accelerating agent is dispersed in said inflation fluid as it passes through said annular inflation passageway, thereby accelerating the hardening time of said inflation fluid.

24. The apparatus of claim 23, wherein said packer mandrel comprises:

an upper mandrel connected to said upper adapter; and a lower mandrel attached to said upper mandrel, wherein said spiral grooves are defined on said lower mandrel and wherein said inflatable packer bladder is disposed about said lower mandrel.

25. The apparatus of claim 24 further comprising:

a check valve disposed about said mandrel, wherein said check valve allows flow only in a direction into said packer bladder.

26. The apparatus of claim 23, further comprising a check valve disposed in said annular inflation fluid passageway dividing said passageway into an upper portion and a lower portion, wherein said spiral grooves are defined on said mandrel adjacent said lower portion of said passageway and said packer bladder is adjacent said lower portion of said annular inflation fluid passageway, and wherein said check valve allows one way fluid flow from said upper portion to said lower portion of said annular inflation passageway.

27. The apparatus of claim 26, wherein said packer body further comprises:

an packer element having an upper end and a lower end, said packer element including said inflatable packer bladder;

an upper end ring attached to said upper end of said packer element, said upper end ring having an accelerator fill port defined therein communicated with said lower portion of said passageway; and a lower end ring attached to said lower end of said packer element, said lower end ring having an accelerator fill port defined therein communicated with said lower portion of said annular inflation passageway.

28. The apparatus of claim 23 further comprising:

circulation means operably associated with said packer bladder for communicating said central flow passage with a well bore, so that said central passage communicates with said well bore after said packer bladder reaches a maximum inflation pressure.

29. The apparatus of claim 28 wherein said circulation means comprises:

said inflation port; and a circulation port defined in said packer body communicated with said inflation port, said circulation port being operably associated with said packer bladder, wherein flow through said circulation is initially blocked and wherein said circulation port opens only after said bladder reaches said maximum inflation pressure, thereby communicating said central flow passage with said well bore.

* * * * *